US005505032A

United States Patent [19]

Wasserman et al.

[11] Patent Number: 5,505,032

[45] Date of Patent: Apr. 9, 1996

[54] THREE WAY DRYWALL CORNER TRIM

[76] Inventors: James J. Wasserman, 412 Hilldale Dr., Decatur, Ga. 30030; William R. Halter, 2230 Peachtree Rd., Apt. A-2, Atlanta, Ga. 30339

[21] Appl. No.: 80,409

[22] Filed: Jun. 18, 1993

[51] Int. Cl.[6] ..... E04B 2/00

[52] U.S. Cl. ..... 52/287.1; 52/254; 52/255

[58] Field of Search ..... 52/287.1, 288.1, 52/254, 255

[56] References Cited

U.S. PATENT DOCUMENTS

| | | | |
|---|---|---|---|
| 1,753,596 | 4/1930 | Bowman | 52/255 |
| 2,274,317 | 2/1942 | Bonnell | 52/288.1 |
| 2,796,641 | 6/1957 | Wollaeger | 52/255 |
| 3,109,207 | 11/1963 | Cooper | 52/255 |
| 3,323,264 | 6/1967 | Cross | 52/287.1 |
| 3,350,825 | 11/1967 | Rillo | 52/287.1 |
| 3,391,509 | 7/1968 | Fruman | 52/255 |
| 3,942,295 | 3/1976 | Schacht | 52/287.1 |
| 4,313,991 | 2/1982 | Lamb | 52/255 |
| 4,324,079 | 4/1982 | Pearson . | |
| 4,863,774 | 9/1989 | Tucker . | |
| 5,045,374 | 9/1991 | Tucker . | |
| 5,048,247 | 9/1991 | Weldy . | |
| 5,086,598 | 2/1992 | Weldy | 52/288.1 |
| 5,131,198 | 7/1992 | Ritchie et al. | 52/287.1 |
| 5,138,810 | 8/1992 | Kartler | 52/255 X |

*Primary Examiner*—Carl D. Friedman
*Assistant Examiner*—Christopher Todd Kent
*Attorney, Agent, or Firm*—Jones & Askew

[57] ABSTRACT

A corner trim member for use in drywall or other sheet wall construction. The cover trim has at least two wall members joining each other along a common edge, so that each wall member can overlay a corresponding corner portion of mutually-orthogonal drywall panels. Each side member of the trim has a relatively thick portion extending from a corner common to the wall members, and a second portion of reduced thickness relative to the first portion. The difference in thicknesses of the two wall portions is substantially equal to the thickness of a conventional cornerbead member with which the trim is used. Those cornerbead members overlay the relatively thin portion of the trim, so that the cornerbead is substantially flush with the relatively thick portions of the cap. The present trim thus provides structural underpinning for drywall finishing mud applied to a wall corner covered by the trim.

5 Claims, 3 Drawing Sheets

THREE WAY DRYWALL CORNER TRIM

FIELD OF THE INVENTION

The present invention relates in general to drywall construction, and relates in particular to an improved drywall interior exposed corner finishing trim to be used with existing cornerbead strips.

BACKGROUND OF THE INVENTION

In current building construction, it is sometimes necessary, due to architectural design, to construct a three-way corner intersection whereby wall surfaces at 90 degrees to each other come together to form an outside corner. Example constructions are a half-height partition wall or "knee wall" to separate interior spaces, suspended soffit fascia, and other similar constructions. These types of construction, due to their specific nature, generally have as a minimum three exposed finished surfaces. Current construction technology with sheet wallboard (hereinafter called "drywall") uses a galvanized metal or a stiff water-impervious plastic cornerbead to produce a finished rigid corner. Cornerbead strips are attached on each of the exterior 90-degree corners, converging at each point where three separate drywall planes come together. It is common in the current construction industry to apply a wet plaster, sometimes called "mud" to cover the cornerbead material. The mud is allowed to dry and then is sanded to conceal the demarcation lines between the cornerbead material and the drywall.

Due to the existing cornerbead technology, a small opening remains at the convergent point where the three pieces of cornerbead come together. This opening is usually filled solid with mud. A disadvantage of this type of conventional corner finishing technique is that the mud cannot take any physical load or impact without crumbling and exposing the open cornerbead convergent point. Such openings are often easily seen, are usually distracting in appearance, and sometimes produce sharp edges which can damage clothing or cause physical injury.

Accordingly, it is an object of the present invention to provide an improved drywall corner trim.

It is another object of the present invention to provide a drywall corner trim affording structural protection to outside corner walls.

It is another object of the present invention to provide a drywall corner trim for simpler and more economical construction of a three-way drywall corner.

It is a further object of the present invention to provide a drywall corner trim usable with existing cornerbead devices.

It is yet another object of the present invention to provide a drywall corner trim usable with existing cornerbeads and providing a corner with improved structural integrity without an unsightly appearance in finished drywall construction.

SUMMARY OF THE INVENTION

In a broad aspect, the present invention is a drywall corner trim element having at least two wall members joining each other along a common edge at an included angle corresponding to the corner angle of drywall construction for which the trim element is intended. The two wall members join each other at a first intersecting point corresponding to a corner of the drywall construction and extend to a remote point along the common edge. The thickness of each wall member along a first portion from the corner intersection to a location intermediate the remote point is relatively thicker than the second portion of the wall. The reduction in thickness between the first and second portions of the wall members is substantially the same as the thickness of the cornerbead expected to overlay the reduced-thickness portion of the corner trim element, so that the combined thickness of that second portion and the overlaying cornerbead is substantially the same as the thickness of the first portion. With the corner trim providing these two thicknesses, an existing cornerbead can be installed to overlap the thinner portion of the cornerbead trim, thus creating a single-thickness corner cap along both portions of the trim. This cap, when concealed by finishing mud, provides a stable and wear-resistant finished corner.

Stated somewhat more particularly, the common edge joining a pair of walls in the present corner trim is somewhat enlarged to form a bulbous or beaded shape as seen in cross-section, corresponding to the shape of existing cornerbead members. In embodiments of the present device having three mutually-orthogonal wall members, each adjoining pair of walls meet at a common edge preferably having the beaded shape. Those common edges intersect at a converging point forming a radiused bulb where the three orthogonal walls meet, and that bulb becomes the apex of a three-way corner intersection to form an outside corner of a wall where the corner trim is installed.

The present invention, as well as other objects and advantages of that invention, will be better understood by reference to the drawings and the preferred embodiments described hereinbelow.

DESCRIPTION OF EMBODIMENTS

Figure 1:
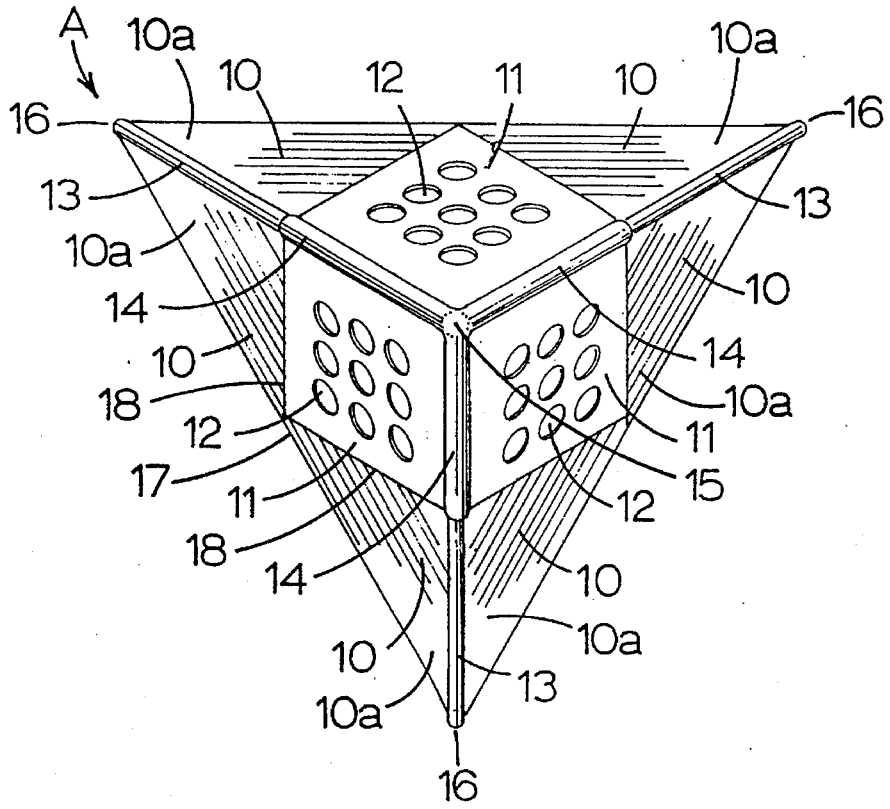
FIG. 1 is a pictorial view of a corner trim element according to a first preferred embodiment of the present invention.
Figure 2:
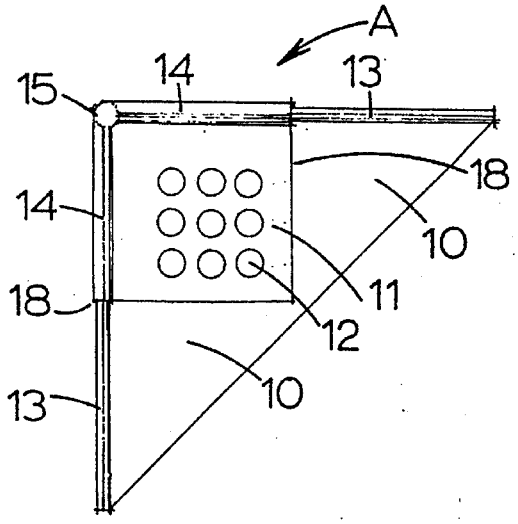
FIG. 2 is a side elevation view of the corner trim shown in FIG. 1.

Referring first to FIGS. 1 and 2, there is shown generally at A cornerbead trim having three mutually-orthogonal walls 10 each of triangular shape. Each wall 10 is joined to the two adjacent walls along a common edge 13, 14 preferably rounded to form a beaded section along its length. The cornerbead trim A thus has the shape of a hollow triangular pyramid. Cornerbead trims according to the present invention can be molded or otherwise formed as one-piece elements of suitable plastic materials such as styrene, polyurethane, ABS, or an acrylic plastic; or can alternatively be formed of suitable metal such as hot-dipped galvanized steel. However, the choice of materials used to fabricate cornerbead trims according to the present invention is not considered a critical aspect of the invention.

Figure 3:
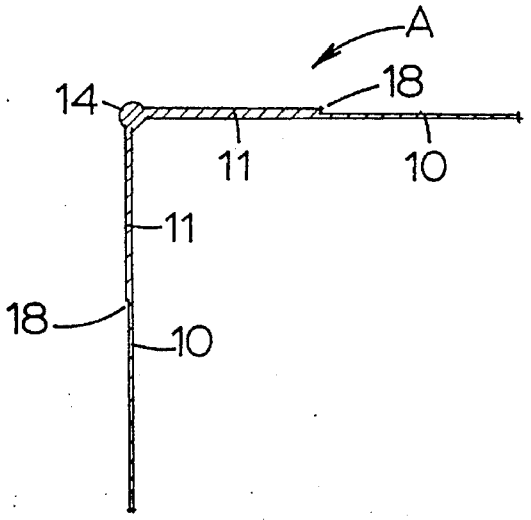
FIG. 3 is a section view of the corner trim shown in FIG. 1, illustrating the two wall thicknesses.

The three common edges 13, 14 joining the walls 10, converge to join each other at the corner point 15. That corner point 15 preferably is formed with a bulbous shape as best seen in FIGS. 2 and 3.

Each wall 10 has a relatively thick portion 11 extending from the corner point 15 to a location intermediate the corner point and the distal end 16 of each common edge 13, and a relatively thinner wall portion 10*a* extending from the intermediate location to the distal end. These relatively thick wall portions 11 are best seen in FIG. 1 and 3 and each is square in shape, with one corner of each wall portion being congruent with the corner point 15 and the diagonal opposite corner lying on the opposite edge 17 constituting the hypotenuse of the corresponding triangular wall 10. The boundary edges 18 between the thick portion 11 and thin portion 10*a* of each wall 10 are best seen in FIGS. 2 and 3. Each of the thicker wall portions 11 preferably has a textured outer surface provided by indentations or perforations 12 formed therein, to aid in the adhesion of finishing mud to those outer surfaces as will become apparent. The indentations or perforations 12 in a preferred embodiment are 3/16 inches in diameter and are centered that same distance in from the outer edges of the thicker wall portions, although those dimensions are by way of example and are not considered limiting.

In a preferred embodiment of the present invention, the difference in thickness between each thicker wall portion 11 and the adjacent thinner wall portion 10*a* of the wall 10 will substantially match the wall thickness of existing cornerbead members with which the cornerbead trim is to be used. The thickness of existing cornerbead members typically is 0.013 inches to 0.020 inches, and so the thickness of each wall portion 11 thus exceeds the thickness of each wall portion 10*a* by approximately that amount. However, the thickness of existing cornerbead members may vary between manufacturers, and it may be desirable or necessary to select the thickness of the wall portions 11 for use with particular sizes of cornerbead members. The reason for the wall portions 11 of relatively greater thickness is pointed out below.

Further matching the dimensions of existing cornerbead members, the diameter of the bead along each common edge 14 adjacent the thicker wall portions 11 preferably is 1/8 inch. The diameter of the bulbous corner point 15 likewise is 1/8 inch in diameter, matching the diameter of the cornerbeads on the common edges 14 radiating from the corner point. The diameter of each beaded common edge is reduced to a diameter of 1/16 inch along the common edges 13 extending adjacent the thinner wall portions 10*a*. The total length of each side 10 in a preferred embodiment is 2 3/8 inches, with the thicker wall portions 11 being 1 1/8 inches on each common edge 14.

Figure 4:
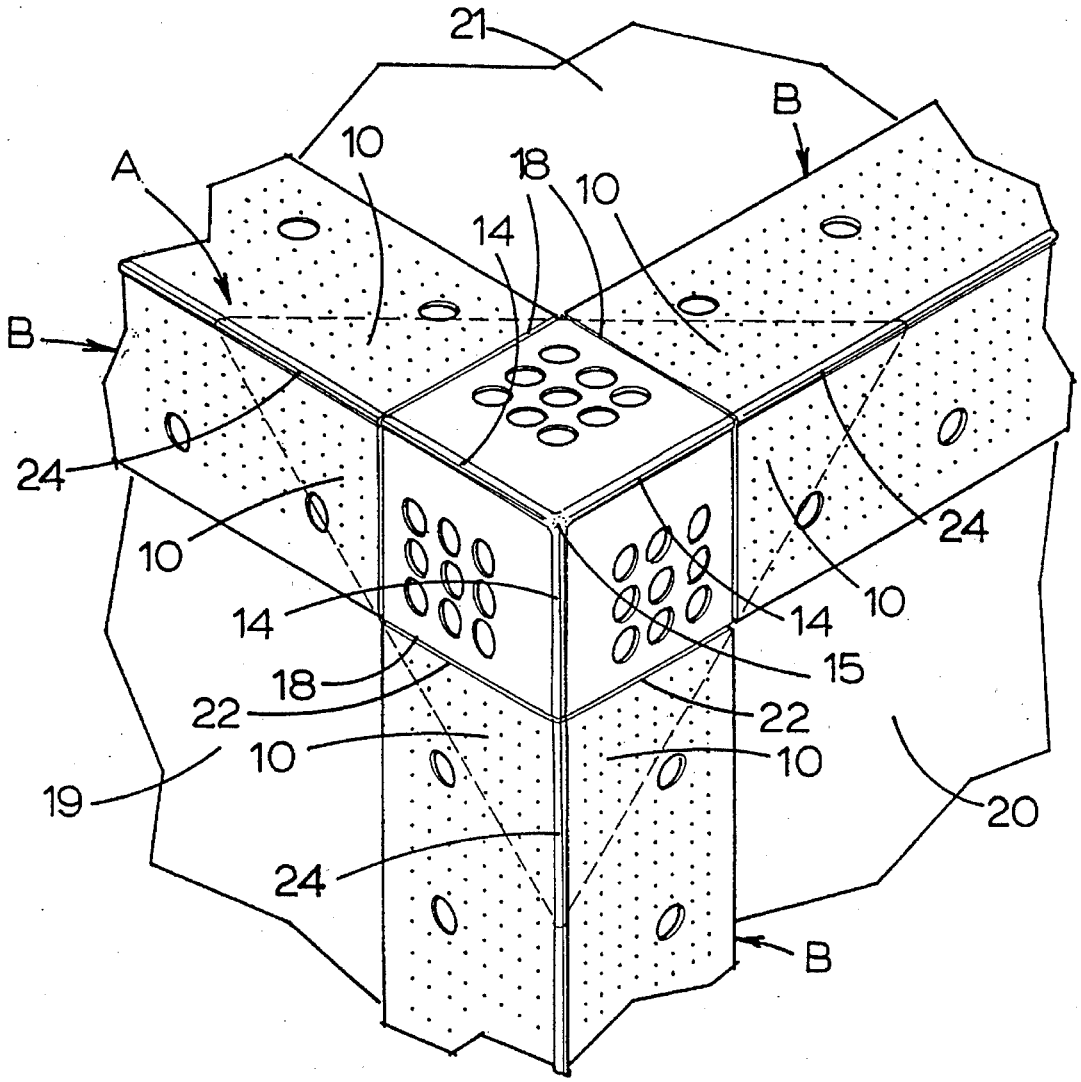
FIG. 4 shows the corner trim of FIGS. 1–3 installed with existing cornerbead technology.

Turning now to FIG. 4, the installation and operation of the cornerbead trim A is described. That figure shows a fragmentary portion of a typical half-height corner construction defined by the orthogonal convergence of the two vertical walls 19 and 20 and the horizontal wall 21. To close the gaps at and near the point of convergence of those three walls, the cornerbead trim A is placed on the walls with the corner point 15 of the cap disposed at the point of convergence of the walls. The cornerbead trim A can be nailed, screwed, or otherwise fastened into place onto the underlying drywall surfaces. After the trim A is in place, adjacent cornerbead strips B of conventional construction are attached in place over the three edges between the wall pairs 19, 20; 20, 21; and 21, 19. The end edges 22 of each cornerbead strip B abut the boundary edges 18 of the thicker wall portions 11 on the cornerbead trim, with the result that the ends of the cornerbead strips overlie the thinner portions 10*a* of the cornerbead trim. Because the thickness of each thick wall portion 11 is greater than the surrounding thin wall portion 10*a* by an amount substantially equal to the thickness of the adjacent cornerbead strip, the outer surface of each cornerbead strip thus is substantially flush with the outer surface of the adjacent thick wall portion 11. Consequently, there is substantially no perceptible difference in height between each thick wall portion 11 and the adjacent cornerbead strip B.

With the cornerbead trim A and the cornerbead strips B thus installed on the corner formed by the three walls 19–21, finishing mud can be applied to that corner treatment. The aforementioned indentations or perforations 12 in the outer surfaces of the thick wall portions 11 help the mud adhere to the cornerbead trim A. The beaded radius of the common edges 14 substantially matches the radius of the beaded edge 24 on each abutting cornerbead strip B. The resulting mudded joint construction can be sanded to a relatively smooth finish lacking any significant visible imperfections caused by unequal height or thickness at the corner, and the cornerbead trim A provides a solid structural underpinning for the mud at the apex of the three walls 19–21.

Figure 5:
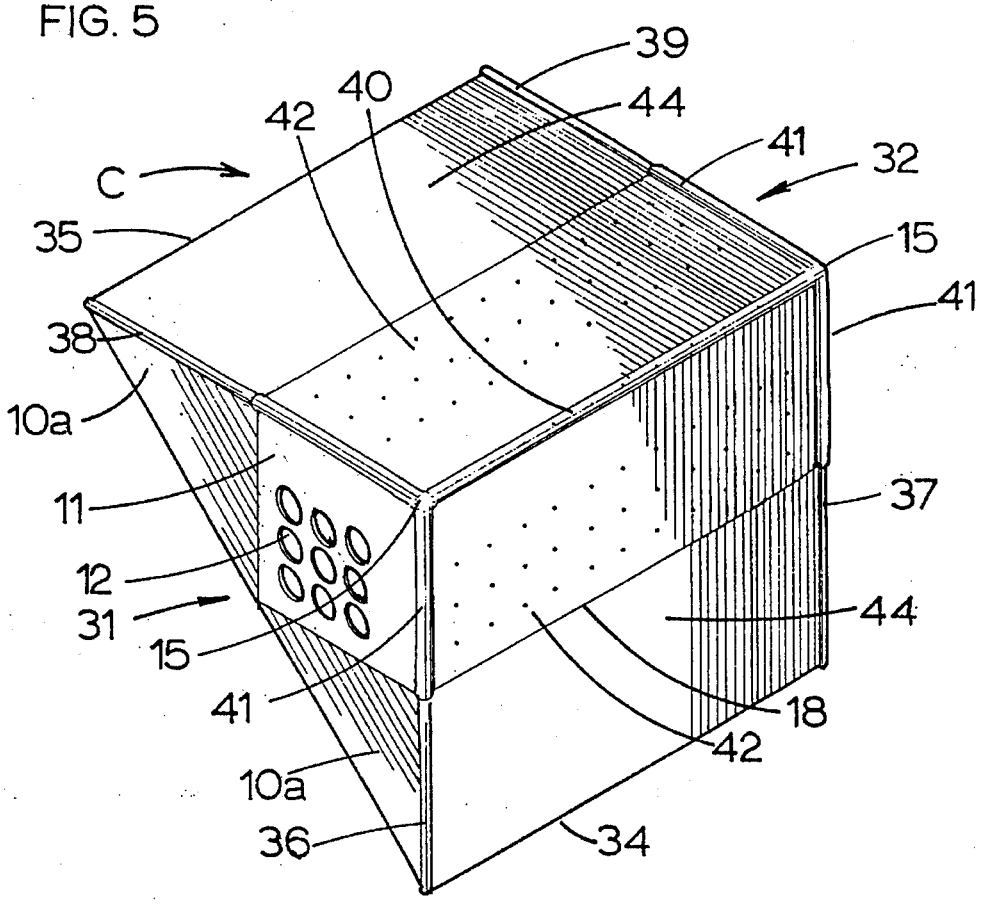
FIG. 5 is a pictorial view of a corner trim element according to a second preferred embodiment, showing a corner trim intended for use on half-height partition walls of extended thickness.
Figure 6:
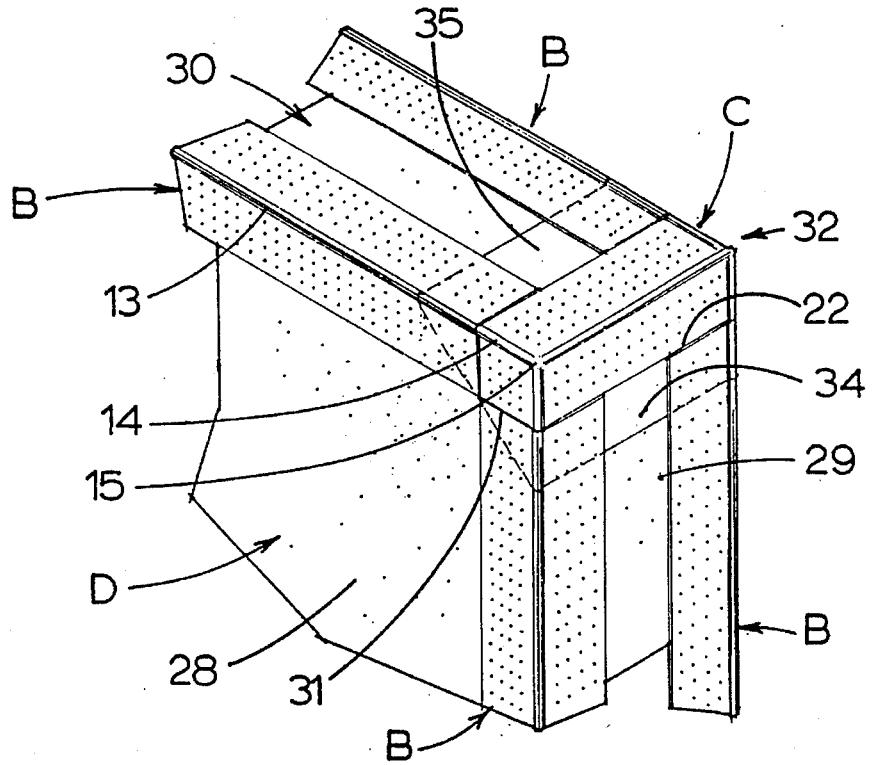
FIG. 6 shows the embodiment of FIG. 5 installed with existing cornerbead technology.

Turning next to FIGS. 5 and 6, there is shown a corner wall trim cap C according to an alternative embodiment of the invention. The corner wall cap C is intended for use on half-height partition walls D as shown in FIG. 6, wherein a first wall 28 and an adjacent parallel wall (not shown) are separated by a relatively narrow vertical wall strip 29 and horizontal wall strip 30.

The corner wall cap C has a pair of side walls 31 and 32 triangular in overall shape. Each of these side walls 31 and 32 is structurally the same as one side of the pyramidal cornerbead trim A shown in FIGS. 1–4, so that each side wall has a thick wall portion 11 flanked by a pair of triangular thin wall portions 10*a*. Details of the side wall 32 are hidden in FIG. 5, but that side wall is identical but of opposite hand to the side wall 31.

The two side walls 31 and 32 are mutually parallel and are separated in spaced-apart relation to each other by a pair of rectangular end walls 34 and 35. Opposite edges 36 and 37 of the end wall 34 join the side walls 31 and 32, so that those opposite edges form a common edge 41 between that end wall and the side walls. Similarly, opposite edges 38 and 39 of the end wall 35 form common edges 41 with the side walls 31 and 32. The end walls 34 and 35 thus are mutually orthogonal to each other and to the side walls 31 and 32, and the end walls join each other along a beaded common edge 40 extending between the corner points 15 of the two side walls.

Each end wall 34 and 35 has a relatively thick wall portion 42 extending outwardly from the common edge 40 joining the two end walls. The thick wall portion 42 of each end wall is rectangular and has ends coextensive with the thick wall portions 11 on the side walls 31 and 32 of the corner wall cap C. The remaining portion 44 of each end wall 34 and 35 is a relatively thin wall portion and likewise is rectangular in shape. It should now be apparent that the difference in thickness between the thin wall portion 44 and thick wall portion 42 of each end wall is substantially equal to the thickness of the cornerbead strips with which the corner wall cap C is to be used.

The application of the corner wall cap C is shown in FIG. 6. That cap first is applied to the half-height wall shown in that figure, so that the side walls 31 and 32 of the corner wall cap overlie the corners of the drywall sheets making up the half-height partition wall. The thin wall portion 44 of each end wall 35 is concurrent along common portions of the edges 37 and 38 with the thin portions 10*a* of the walls 10 on each side wall 31, 32. The end walls 34 and 35 of the cap C thus overlie terminal portions of the drywall strips 29 and 30 separating the two wall panels. The corner wall cap C is secured in position by nails, screws, or other fasteners aforementioned. Once the corner wall cap C is in place, conventional cornerbead strips B are affixed to the wall panels covering the joints between separate panels.

As discussed above with regard to the embodiment shown in FIGS. 1–4, the end 22 of each cornerbead strip B overlies the relatively thin portions 10*a* and 44 of the cap, with an end 22 of each strip B abutting a boundary edge 18 between relatively thick wall portions 43 and relatively thin wall portions 44 of the cap. The thin wall portions of the corner wall cap C thus are hidden by the cornerbead strips B, and those strips are substantially flush with the exposed thick wall portions of the cap. Mud is applied to the corner wall cap C, the cornerbead strips B, and adjacent portions of the drywall panels as aforementioned, with the corner wall cap providing a structural underpinning for the mud at the apex of the wall.

Although the two disclosed embodiments have three or more walls and are intended for use with three-surface corners, it should now be apparent that the present corner trim can be adapted to uses on two-wall corner construction.

It should now be apparent that the foregoing relates only to preferred embodiments of the present invention, and that changes and modifications thereto may be made without departing from the spirit or scope of the invention as defined in the following claims.

What is claimed is:

1. A trim member for application to a wall corner joint of predetermined included angle formed by three panels converging to an apex common to a corner of each wall and covered by a cornerbead strip of certain thickness on at least one joint between two such panels, the trim member comprising:

three wall members, each wall member being triangular in shape and joined to two other said wall members along two edges common m the joined wall members, the included angle between any two of the wall members adapted to be the same as the predetermined included angle of the wall corner joint, and the three wall members being mutually joined at a corner point common to each wall member;

each wall member having a rectangular portion with one corner at the corner point and an opposite corner at the side of the wall member opposite the corner point, thereby defining a distal portion of each wall member beyond the rectangular portion; and the rectangular portion having an increased thickness greater than the thickness of the reminder of each wall member, said increased thickness adapted to be substantially equal to said thickness of the cornerbead strip, so that an end of the cornerbead strip overlies the distal portions of the two contiguous wall members in abutting and substantially flush relation with the rectangular portions when the trim member is placed on the apex of the wall corner joint.

2. The trim member as in claim 1, wherein the wall corner joint is formed by three mutually-orthogonal panels and the wall members of the trim member ate mutually orthogonal.

3. A trim member for application to a wall corner joint of predetermined included angle formed by three panels converging to an apex common to a corner of each wall and covered by a cornerbead strip of certain thickness on at least one joint between two such panels, the trim member comprising:

three wall members, each wall member being triangular in shape and joined to two other said wall members along two edges common to the joined wall members, the included angle between any two of the wall members adapted to be the same as the predetermined included angle of the wall corner joint, and the three wall members being mutually joined at a corner point common to each wall member;

each wall member having a rectangular portion with one corner at the corner point and two sides extending from the corner point along the edges of the wall members to terminate at an intermediate point on each edge, the remainder of each wall member forming a distal portion beyond the rectangular portion;

the other two sides of each rectangular portion extending on the respective wall members from the intermediate points toward the side of the wall member opposite the corner point; and the rectangular portion of each wall member having a thickness greater than the thickness of the distal portion, said increased thickness adapted to be substantially equal to said thickness of the cornerbead strip, so that an end of the cornerbead strip overlies the distal portions of the two contiguous wall members in abutting and substantially flush relation with said other two sides of the rectangular portions when the trim member is placed on the apex of the wall corner joint.

4. A trim member for application to a half-height partition wall formed by a first wall panel and a parallel second wall panel separated by a pair of wall strips, each wall panel having first and second edges converging to an apex having a predetermined included angle, with one of the wall strips extending between the fast edges of the wall panels and the other wall strip extending between the second edges of the wall panels, the wall strips meeting each other along a common edge extending between the apexes of the two wall panels, and wherein a cornerbead strip of certain thickness covers at least one joint between a wall panel and a wail strip, the trim member comprising:

a pair of triangular wall members disposed in parallel relation to each other by a pair of other wall members joined to the triangular wall members along edges common to the joined wall members, each triangular wall member being joined with the other wall members at a corner point common to the triangular wall member and the other wall members, and the other wall members joining each other along a common edge extending between the corner points;

the included angles of the corner points adapted to be the same as the predetermined included angles of the wall corner joint;

each triangular wall member having a rectangular portion with one corner at the corner point of that triangular wall member, each rectangular portion having two sides extending from the corner point along the edges of the triangular wall member to terminate at an intermediate point on each edge, and the remainder of each triangular wall member forming a distal portion beyond the rectangular portion;

the other two sides of each rectangular portion extending on the respective triangular wall members from the intermediate points toward the side of the triangular wall member opposite, the corner point for that triangular wall member;

the rectangular portion of each triangular wall member having an increased thickness greater than the thickness of the distal portion;

each other wall member having a proximal portion extending outwardly from the common edge to terminate at an intermediate boundary aligned with said intermediate points on the edges of the triangular walls, the remaining portion of each other wall member forming a distal the proximal portion of each other wall member having an increased thickness greater than the thickness of the distal portion there of; and said increased thickness of said proximal portions adapted to be substantially equal to the thickness of the cornerbead strip, so that an end of the cornerbead strip overlies the distal portions of the contiguous triangular wall member and other wall member in abutting and substantially flush relation with said other two sides of the rectangular portions and said intermediate boundary of the other wall member when the trim member is placed on the apex of the wall corner joint.

5. The trim member as in claim 4, wherein the other wall members of the trim member are rectangular.

* * * * *